US011008525B2

(12) United States Patent
Bodas et al.

(10) Patent No.: US 11,008,525 B2
(45) Date of Patent: May 18, 2021

(54) OCTANE-BOOSTING FUEL ADDITIVES, METHOD OF MANUFACTURE, AND USES THEREOF

(71) Applicant: SABIC Global Technologies B.V., Bergen op Zoom (NL)

(72) Inventors: Vijay Dinkar Bodas, Riyadh (SA); Sultan Eid Al-Otaibi, Riyadh (SA); Guillermo Leal, Riyadh (SA); Mohammed Bismillah Ansari, Riyadh (SA); Naif Mohammed Al Naddah Al-Otaibi, Riyadh (SA)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 16/493,203

(22) PCT Filed: Mar. 19, 2018

(86) PCT No.: PCT/IB2018/051823
§ 371 (c)(1),
(2) Date: Sep. 11, 2019

(87) PCT Pub. No.: WO2018/172911
PCT Pub. Date: Sep. 27, 2018

(65) Prior Publication Data

US 2020/0131448 A1 Apr. 30, 2020

Related U.S. Application Data

(60) Provisional application No. 62/474,700, filed on Mar. 22, 2017.

(51) Int. Cl.
*C10L 1/185* (2006.01)
*C10L 1/02* (2006.01)
*C10L 10/10* (2006.01)

(52) U.S. Cl.
CPC ..... *C10L 1/1855* (2013.01); *C10L 1/023* (2013.01); *C10L 10/10* (2013.01); *C10L 2200/0423* (2013.01); *C10L 2270/023* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,036,904 | A | 5/1962 | Chafetz et al. | |
| 4,617,026 | A | 10/1986 | Shaub et al. | |
| 5,919,372 | A | 7/1999 | Galante et al. | |
| 5,993,498 | A | 11/1999 | Vrahopoulou et al. | |
| 2003/0183554 | A1* | 10/2003 | Bazzani | C10L 1/02 208/16 |
| 2010/0048940 | A1 | 2/2010 | Tulchnsky et al. | |
| 2014/0350269 | A1* | 11/2014 | Eiji Borges Sato | C10L 1/191 549/370 |
| 2016/0024411 | A1 | 1/2016 | Arondel et al. | |

FOREIGN PATENT DOCUMENTS

| | | | |
|---|---|---|---|
| EP | 0968259 | B1 | 5/2000 |
| EP | 2298851 | B1 | 3/2011 |
| RU | 2365617 | | 8/2009 |
| WO | 2009010527 | A1 | 1/2009 |
| WO | 2010053354 | A2 | 5/2010 |
| WO | 2012163935 | A2 | 12/2012 |
| WO | 2013067097 | A1 | 5/2013 |
| WO | 2015089005 | A1 | 6/2015 |

OTHER PUBLICATIONS

Guemez et al.; "Acetalization reaction between glycerol and n-butyraldehyde using an acidic ion exchange resin. Kinetic modelling"; Chemical Engineering Journal; vol. 228; 2013; pp. 300-307.
International Search Report for International Application No. PCT/IB2018/051823, Application Filing Date Mar. 19, 2018, dated Sep. 17, 2018, 6 pages.
Kubic JR., William L.; "A Group Contribution Method for Estimating Cetane and Octane Numbers"; Los Alamos report LA-UR-16-25529; Jul. 2016; 69 pages.
Written Opinion for International Application No. PCT/IB2018/051823; Application Filing Date Mar. 19, 2018, dated Sep. 17, 2018, 8 pages.

* cited by examiner

*Primary Examiner* — Ellen M McAvoy
*Assistant Examiner* — Chantel L Graham
(74) *Attorney, Agent, or Firm* — Cantor Colburn LLP

(57) ABSTRACT

A method of manufacturing an octane-boosting fuel additive, the method comprises reacting n-butyraldehyde, isobutyraldehyde, or a combination comprising at least one of the foregoing with glycerol in the presence of an acidic catalyst to obtain an octane-boosting product mixture comprising 2-propyl-5-hydroxy-1,3-dioxane, 2-isopropyl-5-hydroxy-1,3-dioxane, 2-propyl-5-hydroxymethyl-1,3-dioxolane, 2-isopropyl-5-hydroxymethyl-1,3-dioxolane, or a combination comprising at least one of the foregoing.

20 Claims, No Drawings

OCTANE-BOOSTING FUEL ADDITIVES, METHOD OF MANUFACTURE, AND USES THEREOF

CROSS REFERENCE TO RELATED APPLICATIONS

This application is a National Stage application of PCT/IB2018/051823, filed Mar. 19, 2018, which claims the benefit of U.S. Provisional Application No. 62/474,700, filed Mar. 22, 2017, both of which are incorporated by reference in their entirety herein.

BACKGROUND

This disclosure is directed to improved octane boosters for gasoline, a process for making the octane boosters, and gasolines containing the octane boosters.

Commercial gasoline, which is fuel for internal combustion engines, is a refined petroleum product that is typically a mixture of hydrocarbons (base gasoline), additives, and blending agents. Additives and blending agents are added to the base gasoline to enhance the performance and the stability of gasoline, and can include anti-knock agents, anti-oxidants, metal deactivators, lead scavengers, anti-rust agents, anti-icing agents, upper-cylinder lubricants, detergents, and dyes.

When used in high compression internal combustion engines, gasoline has the tendency to "knock." Knocking occurs when combustion of the air/fuel mixture in the cylinder does not start off correctly in response to ignition because one or more pockets of air/fuel mixture pre-ignite outside the envelope of the normal combustion front. Anti-knocking agents, also known as octane boosters, reduce the engine knocking phenomenon, and increase the octane rating of the gasoline. Prior octane boosters such as tetraethyl lead and methylcyclopentadienyl manganese tricarbonyl (MMT) have been or are being phased out for environmental, health, or other reasons.

Preferred compounds in present use for formulating octane boosters include $C_4$ oxygenate compounds such as methyl tert-butyl ether (MTBE), ethyl tert-butyl ether (ETBE), and n-butanol and its isomers. However, the production and storage of the large quantities of these materials at oil refineries can be costly. In addition, limitations on the use of high concentrations of additives by regulatory mandate increase the difficulty and expense of refining operations that produce high-octane fuels.

In view of the foregoing, there remains a need to provide cost-effective methods for producing octane-boosting fuel additives and for gasoline compositions including the octane-boosting fuel additives.

BRIEF DESCRIPTION

A method of manufacturing an octane-boosting fuel additive comprises reacting n-butyraldehyde, iso-butyraldehyde, or a combination comprising at least one of the foregoing with glycerol in the presence of an acidic catalyst to obtain an octane-boosting product mixture comprising 2-propyl-5-hydroxy-1,3-dioxane, 2-isopropyl-5-hydroxy-1,3-dioxane, 2-propyl-5-hydroxymethyl-1,3-dioxolane, 2-isopropyl-5-hydroxymethyl-1,3-dioxolane, or a combination comprising at least one of the foregoing.

A method of manufacturing an octane-boosting fuel additive comprises reacting 2-ethylhexenaldehyde, 2-ethylhexaldehyde, or a combination comprising at least one of the foregoing with glycerol in the presence of an acidic catalyst to obtain an octane-boosting product mixture comprising 2-(hept-3-en-3-yl)-5-hydroxy-1,3-dioxane, 2-(heptan-3-yl)-5-hydroxy-1,3-dioxane, 2-(hept-3-en-3-yl)-5-hydroxymethyl-1,3-dioxolane, 2-(heptan-3-yl)-5-hydroxymethyl-1,3-dioxolane, or a combination comprising at least one of the foregoing.

Also disclosed is an octane-boosting fuel additive made by any of these methods.

An unleaded gasoline composition comprises 70 to 99.8 volume percent of an unleaded gasoline; and 0.2 to 20 volume percent of the octane-boosting fuel additive, wherein the unleaded gasoline composition has a higher Research Octane Number, determined in accordance with ASTM D 2699, and a higher Motor Octane Number, determined in accordance with ASTM D 2700, than the unleaded gasoline without the octane-boosting fuel additive.

The above described and other features are exemplified by the following detailed description, examples, and claims.

DETAILED DESCRIPTION

Described herein are processes for manufacturing octane-boosting fuel additives, the octane-boosting fuel additives, and unleaded gasoline compositions comprising the octane-boosting fuel additives. The octane-boosting fuel additives have a low Reid vapor pressure (RvP) and are calculated to have a high theoretical research octane number (RON) and motor octane number (MON), which is an advantageous combination of attributes for an octane-boosting fuel additive for gasoline compositions, particularly for the automotive market.

An octane-boosting fuel additive can be manufactured by reacting n-butyraldehyde, iso-butyraldehyde, or a combination comprising at least one of the foregoing with glycerol in the presence of an acidic catalyst. The reaction yields an octane-boosting fuel additive comprising 2-propyl-5-hydroxy-1,3-dioxane, 2-isopropyl-5-hydroxy-1,3-dioxane, 2-propyl-5-hydroxymethyl-1,3-dioxolane, 2-isopropyl-5-hydroxymethyl-1,3-dioxolane, or a combination comprising at least one of the foregoing.

Alternatively, an octane-boosting fuel additive can be manufactured by reacting 2-ethylhexenaldehyde, 2-ethylhexaldehyde, or a combination comprising at least one of the foregoing with glycerol in the presence of an acidic catalyst. The reaction yields an octane-boosting fuel additive comprising 2-(hept-3-en-3-yl)-5-hydroxy-1,3-dioxane, 2-(heptan-3-yl)-5-hydroxy-1,3-dioxane, 2-(hept-3-en-3-yl)-5-hydroxymethyl-1,3-dioxolane, 2-(heptan-3-yl)-5-hydroxymethyl-1,3-dioxolane, or a combination comprising at least one of the foregoing.

The n-butyraldehyde, iso-butyraldehyde, or the combination comprising at least one of the foregoing can be in the form of individual, isolated compounds or can be a purified or crude product or by-product of a chemical process such as butanol or 2-ethylhexanol production. For example the n-butyraldehyde, iso-butyraldehyde, or combination comprising at least one of the foregoing can be obtained as a crude undistilled by-product of butanol or 2-ethylhexanol production. There is no particular restriction on the relative amounts of each of the foregoing butyraldehyde components.

The 2-ethylhexenaldehyde, 2-ethylhexaldehyde, or a combination comprising at least one of the foregoing can be individual, isolated compounds or can be a purified or crude product or by-product of a chemical process. For example, the 2-ethylhexenaldehyde, 2-ethylhexaldehyde, or combination comprising at least one of the foregoing can be obtained as a result of dehydration of the aldol keto-enol reaction product of butyraldehyde of n-butyraldehyde, iso-butyraldehyde, or a combination comprising at least one of the foregoing. There is no particular restriction on the relative amounts of 2-ethylhexenaldehyde and 2-ethylhexaldehyde.

The glycerol can be purified glycerol or can be crude glycerol, for example a crude glycerol from biodiesel production, which generates on the order of 10% (w/w) glycerol as its main by-product. Utilization of the crude glycerol co-product from biodiesel production has been viewed as one of the most promising options for lowering biodiesel production cost.

The mole ratio of aldehyde to glycerol in either reaction process can be 0.8:1 to 1.5:1, preferably 1:1.

Many acidic catalysts are known and inorganic or organic acids can be use. Exemparly acidic catalysts include, for instance, hydrochloric acid, sulfuric acid, aliphatic and aromatic sulfonic acids such as p-toluenesulfonic acid and methanesulfonic acid, phosphoric acid, perchloric acid, hydrobromic acid, hydrofluoric acid, and dihydroxyfluoboric acid. Other catalysts are thionyl chloride, boron trifluoride, silicon tetrafluoride, stearates such as zinc stearate and aluminum stearate, the chlorides of magnesium, aluminum, iron, zinc, copper and tin and salts of mercury, silver, cobalt, nickel and cerium. Organometallic catalysts can be used, for example tetraisopropyl titanate, tetra-n-butyl titanate, dibutyltin oxide, dioctyltin oxide, hafnium acetylacetonate and zirconium acetylacetonate. Preferred catalysts include p-toluene sulphonic acid, zinc stearate, tetraisopropyl titanate, or a combination comprising at least one of the foregoing.

The amount of catalyst is 0 to 5 weight percent (wt. %) based on the total weight of the reactants, i.e., the one or more aldehydes and the glycerol, or 0.05 to 5 wt. %, preferably 0.1 to 4 wt. %, based on the total weight of the reactants.

The temperature for the reaction can be from 0 to 175° C., preferably 23 to 165° C. The pressure for the reaction can be from 0.5 bar (50% vacuum, 0.05 megaPascal (MPa)) to five bar (0.5 MPa), preferably 0.8 bar to four bar (0.008 to 4 MPa).

The method further can comprise isolating the octane-boosting fuel additive compounds from the product mixture. Isolating the octane-boosting fuel additive compounds can include a series of process steps including one or more of distillation, acid neutralization, and filtration, which can be conducted in any order. In an embodiment, the product mixture is distilled to remove at least a portion of the residual butyraldehyde, water, a by-product, or a combination thereof. Distillation can be conducted so as to remove these components sequentially or at the same time.

The catalyst in the product mixture can be inactivated and removed. For example catalyst can be inactivated and removed by a water wash. The acid catalyst in the product mixture can be inactivated by neutralization. Neutralizing the catalyst can comprise adding an aqueous alkaline solution. The amount of aqueous alkaline solution that is added is generally equivalent to the amount of acid present in the reaction mixture. Exemplary bases suitable for use in the aqueous alkaline solution include alkali metal salts, particularly sodium salts such as sodium carbonate, and alkali metal hydroxides such as sodium hydroxide, e.g., aqueous sodium hydroxide.

A vacuum can be drawn over the product vessel to dehydrate the final product. The product can be filtered, for example over a molecular sieve or CELITE prior to use.

RvP, RON, and MON can be measured for each octane-boosting fuel additive disclosed herein or for each gasoline composition comprising the octane-boosting fuel additive.

RvP is a measure of the volatility of a liquid, e.g., gasoline. It is defined as the absolute vapor pressure exerted by a liquid at 100° F. (37.8° C.) as determined by test method ASTM D 323.

RON describes the knocking behavior of a fuel at a low engine load and low rotational speeds and is determined according to ASTM D 2699.

MON describes the behavior of a fuel at a high engine load and under high thermal stress and is determined according to ASTM D 2700.

RON and MON can also be calculated for octane-boosting compounds using various methods, such as those disclosed in Los Alamos report LA-UR-16-25529, "A group contribution method for estimating cetane and octane numbers", William Louis Kubic, issued Jul. 28, 2016.

The research octane numbers of ethers typically range above 110 and those of alcohols are also high. Therefore the research octane number characterizing each of the individual compounds of the octane-boosting fuel additives disclosed herein is expected to be high. Further advantages of the of the individual compounds of the disclosed octane-boosting fuel additives is that their Reid vapor pressure is low and they are not susceptible to peroxide formation in long term strategic fuel reserves when all alcohol groups are esterified. These properties make the disclosed octane-boosting fuel additives attractive candidates as green fuel additives, particularly when using crude glycerol by-product from biodiesel production in the synthetic reactions.

Also disclosed is an unleaded gasoline composition comprising an unleaded gasoline and an octane-boosting fuel additive disclosed herein, wherein the unleaded gasoline composition has a higher RON, determined in accordance with ASTM D 2699, and a higher MON, determined in accordance with ASTM D 2700, than the unleaded gasoline without the octane-boosting fuel additive. The unleaded gasoline composition can have a RON that is 0.5 to 20, or 1 to 15, or 1.5 to 10 points higher than the RON of the unleaded gasoline without the octane-boosting fuel additive. The unleaded gasoline composition can have a MON that is 0.5 to 20, or 1 to 15, or 1.5 to 10 points higher than the MON of the unleaded gasoline without the octane-boosting fuel additive.

The unleaded gasoline composition can also have a Reid Vapor Pressure lower than the unleaded gasoline without the octane-boosting fuel additive, wherein Reid Vapor Pressure is determined in accordance with ASTM D 323. The unleaded gasoline composition can be characterized as having a Reid vapor pressure of 6.0 to 8.0 pounds per square inch (psi), preferably 6.5 to 7.8. The unleaded gasoline composition can have an RvP at least 0.2 psi lower, at least 0.3 psi lower, at least 0.4 psi lower, or at least 0.5 psi lower than the RVP of the unleaded gasoline without the octane-boosting fuel additive.

In the unleaded gasoline composition, the unleaded gasoline is present in an amount of 60 to 99.8 volume percent (vol. %), or 65 to 99 vol. %, or 70 to 99.8 vol. %, or 75 vol. % to 95 vol. %, each based on the total volume of the unleaded gasoline composition. The octane-boosting fuel additive can be present in the unleaded gasoline composition in an amount of 0.2 to 20 vol %, or 0.3 to 15 vol. %, or 0.4 to 10 vol. %, or 0.5 to 7.5 vol. %, each based on the total volume of the unleaded gasoline composition.

The unleaded gasoline composition containing the octane-boosting fuel additive constitutes 2.0 to 5.5 wt. % oxygen.

The unleaded gasoline composition can be prepared by combining an unleaded gasoline and the components of an octane-boosting fuel additive disclosed herein, either separately or in any combination.

The octane-boosting fuel additive or components thereof can be added directly to the unleaded gasoline. However, the octane-boosting fuel additive or components thereof can be diluted with a substantially inert, normally liquid organic diluent such as mineral oil, naphtha, benzene, toluene, or xylene, to form an additive concentrate. These concentrates can comprise 0.1 to 80% by weight, or 1% to 80% by weight, or 10% to 80% by weight, of the octane-boosting fuel additive and can contain, in addition, one or more other additives known in the art as described below. Concentrations such as 15%, 20%, 30% or 50% or higher can be used. The concentrates can be prepared by combining the desired components in any order at any temperature, for example at 23 to 70° C.

The octane-boosting fuel additive or the unleaded gasoline composition can further comprise other additives known in the art, for example anti-foam agents, anti-icing agents, additional anti-knock agents, anti-oxidants, anti-wear agents, color stabilizers, corrosion inhibitors, detergents, dispersants, dyes, extreme pressure agents, lead scavengers, metal deactivators, pour point depressing agents, upper-cylinder lubricants, viscosity improvers, and the like. The amounts of such additives depend on the particular additive, and can be readily determined by one of ordinary skill in the art.

Anti-foam agents used to reduce or prevent the formation of stable foam include silicones or organic polymers. Anti-oxidants, corrosion inhibitors, and extreme pressure agents are exemplified by chlorinated aliphatic hydrocarbons, organic sulfides and polysulfides, phosphorus esters including dihydrocarbon and trihydrocarbon phosphites, molybdenum compounds, and the like. Other anti-oxidants alkylated diphenyl amines, hindered phenols, especially those having tertiary alkyl groups such as tertiary butyl groups in the position ortho to the phenolic —OH group, and the like.

Detergents and dispersants can be of the ash-producing or ashless type. The ash-producing detergents are exemplified by oil-soluble neutral and basic salts of alkali or alkaline earth metals with sulfonic acids, carboxylic acids, phenols, or organic phosphorus acids characterized by a least one direct carbon-to-phosphorus linkage. Ashless detergents and dispersants can yield a nonvolatile residue such as boric oxide or phosphorus pentoxide upon combustion, but do not ordinarily contain metal and therefore does not yield a metal-containing ash on combustion. Examples include reaction products of carboxylic acids (or derivatives thereof) containing 34 to 54 carbon atoms with nitrogen containing compounds such as amine, organic hydroxy compounds such as phenols and alcohols, and/or basic inorganic materials.

Viscosity improvers are usually polymers, for example polyisobutenes, poly(methacrylic acid esters), hydrogenated diene polymers, polyalkyl styrenes, esterified styrene-maleic anhydride copolymers, hydrogenated alkenylarene-conjugated diene copolymers, and polyolefins.

In particular, the octane-boosting fuel additive or the unleaded gasoline composition can further comprise other oxygenate compounds, for example other alcohol, ester, or ether oxygenates. The term "oxygenates" refer to a class of gasoline additives that contain one or more oxygen atoms and are effective to improve the octane rating of gasoline by increasing the oxygen content of the gasoline. Examples of other alcohols that can be included are ethanol, isopropyl alcohol, n-propyl alcohol, tert-amyl alcohol, or a combination comprising at least one of the foregoing. Examples of other ethers that can be included are ethyl tert-butyl ether, tert-amyl methyl ether, tert-amyl ethyl ether, tert-hexyl methyl ether, diisopropyl ether, or a combination comprising at least one of the foregoing. Examples of esters that can be included are isoamyl acetate, amyl acetate, isoamyl propionate, isoamyl nonanoate, isobutyl acetate, methyl butyrate, methyl caproate, methyl caprylate, or a combination comprising at least one of the foregoing. These additional oxygenate compounds can be present in an amount of 0.02 to 20 vol. %, or 0.1 to 10 vol. %, each based on the total volume of the gasoline composition.

Other anti-knock additives include xylene, benzene, toluene, aniline, and the like.

The methods and compositions disclosed are further illustrated by the following examples, which are non-limiting.

EXAMPLES

Example 1. Octane Booster Synthesis from Butyraldehyde

The reaction of n-butyraldehyde or isobutyraldehyde with glycerin gives rise to the products shown in Schemes I and II.

Scheme I

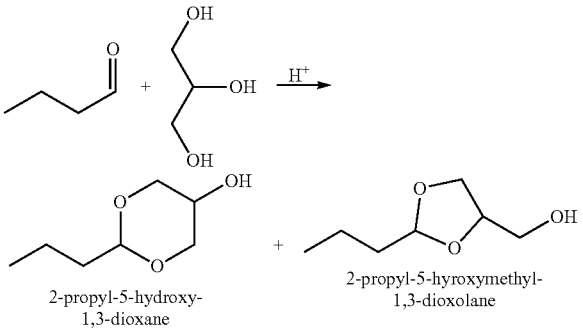

Scheme II

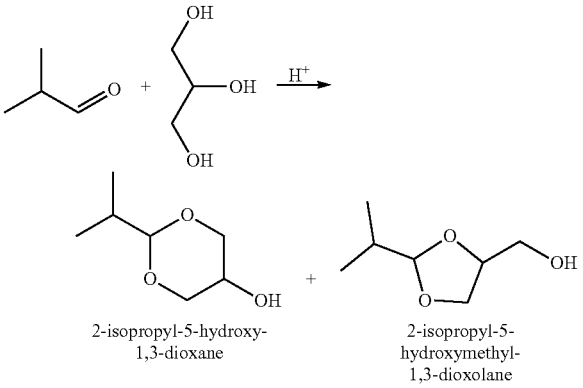

In this reaction, the n butyraldehyde and isobutyraldehyde can be used in the form of individual isolated compounds or in the form of a mixed crude undistilled product from the oxo alcohol synthetic process for making butanol or 2-ethylhexanol.

The catalyst used for this reaction is an acid catalyst such as p-toluene sulphonic acid, zinc stearate, tetraisopropyl titanate, or a combination comprising at least one of the foregoing. The amount of catalyst is 0 to 5% by weight of the total reactants, i.e., the one or more butyraldehydes and the glycerol. The mole ratio of butyraldehyde to glycerol can be 0.8:1 to 1.5:1. The temperature for the reaction can range from 0 to 175° C. and pressure from 0.5 bar (50% vacuum) to five bar.

After reaction, the catalyst is inactivated and removed by a water wash, and then a vacuum is pulled over the product vessel to dehydrate the final product. The dried product is then filtered and ready for use.

Example 2. Octane Booster Synthesis from Dehydrated Aldol

Similarly, 2-ethyl-hexenaldehyde or 2-ethyl-hexaldehyde are reacted with glycerin as shown in Schemes III or IV. The reaction conditions are similar to those of Example 1.

Scheme III

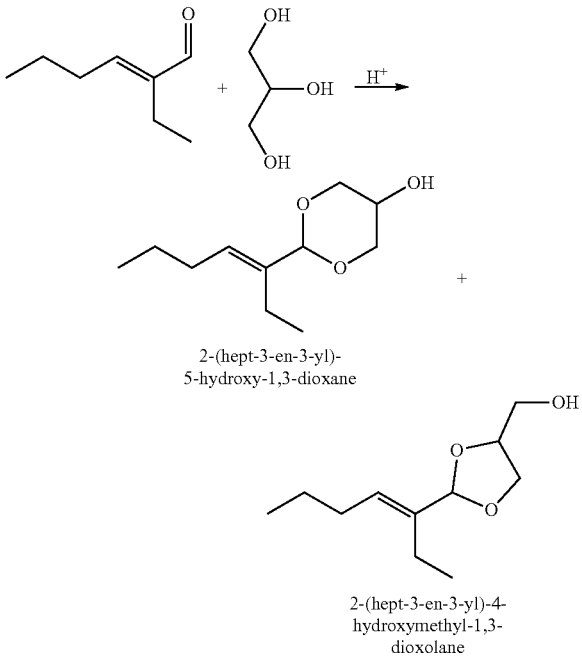

Scheme IV

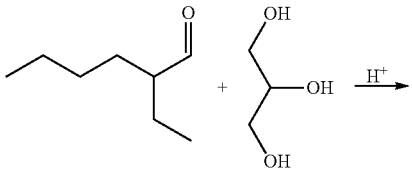

-continued

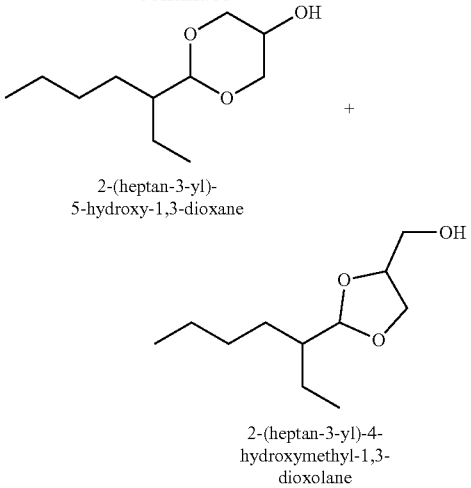

In this reaction, the 2-ethylhexenaldehyde or 2-ethylhexaldehyde can be used in the form of individual isolated compounds or can be obtained as crude product from dehydration of the aldol keto-enol reaction product of butyraldehyde produced in the oxo-alcohol synthetic process for making butanol.

Example 3. Octane Numbers and Reid Vapor Pressure for Octane Boosters

Reid vapor pressure (RvP) is a measure of the volatility of gasoline. It is defined as the absolute vapor pressure exerted by a liquid (e.g., gasoline) at 100° F. (37.8° C.) as determined by test method ASTM D 323. The Reid vapor pressure of the synthesized species is negligible.

RON and MON of each of the species synthesized can be predicted by the methods in Los Alamos report LA-UR-16-25529, "A group contribution method for estimating cetane and octane numbers", William Louis Kubic, Jul. 28, 2016.

Octane numbers are calculated using two different methods from the Los Alamos report, the unbounded polynomial method, and the neural network method. For the compound, 2-propyl-5-hydroxy-1,3-dioxolane the estimated octane numbers calculated by the unbounded polynomial method are RON=106 and MON=94 and by the neural network method are RON 221 and MON 140.

Even the more conservative lower values of RON and MON calculated by the unbounded polynomial method are sufficiently high to make these species attractive as octane-boosting fuel additives that concurrently suppress Reid vapor pressure, allowing blending of more components with higher Reid vapor pressures, such as butane, in a gasoline.

This disclosure further encompasses the following aspects.

Aspect 1. A method of manufacturing an octane-boosting fuel additive, the method comprising reacting n-butyraldehyde, iso-butyraldehyde, or a combination comprising at least one of the foregoing with glycerol in the presence of an acidic catalyst to obtain an octane-boosting product mixture comprising 2-propyl-5-hydroxy-1,3-dioxane, 2-isopropyl-5-hydroxy-1,3-dioxane, 2-propyl-5-hydroxymethyl-1,3-dioxolane, 2-isopropyl-5-hydroxymethyl-1,3-dioxolane, or a combination comprising at least one of the foregoing.

Aspect 2. The method of aspect 1, wherein the n-butyraldehyde, iso-butyraldehyde, or combination comprising at least one of the foregoing is a by-product of butanol or 2-ethylhexanol production.

Aspect 3. The method of aspect 2, wherein the by-product is a crude by-product.

Aspect 4. The method of aspect 3, wherein the crude by-product is undistilled.

Aspect 5. A method of manufacturing an octane-boosting fuel additive, comprising reacting 2-ethylhexenaldehyde 2-ethylhexaldehyde, or a combination comprising at least one of the foregoing with glycerol in the presence of an acidic catalyst to obtain an octane-boosting product mixture comprising 2-(hept-3-en-3-yl)-5-hydroxy-1,3-dioxane, 2-(heptan-3-yl)-5-hydroxy-1,3-dioxane, 2-(hept-3-en-3-yl)-5-hydroxymethyl-1,3-dioxolane, 2-(heptan-3-yl)-5-hydroxymethyl-1,3-dioxolane, or a combination comprising at least one of the foregoing.

Aspect 6. The method of aspect 5, wherein the 2-ethylhexenaldehyde 2-ethylhexaldehyde, or a combination comprising at least one of the foregoing is a by-product of butanol or 2-ethylhexanol production.

Aspect 7. The method of aspect 6, wherein the by-product is a crude by-product.

Aspect 8. The method of any one or more of aspects 1 to 7, wherein the acidic catalyst comprises p-toluene sulphonic acid, zinc stearate, tetraisopropyl titanate, or a combination comprising of at least one of the foregoing.

Aspect 9. The method of any one or more of aspects 1 to 8, wherein the catalyst is present in an amount of 0.05 to 5 weight percent, based on the total weight of the aldehyde and the glycerol.

Aspect 10. The method of any one or more of aspects 1 to 9, wherein the reacting is performed at 0.5 to 5 bar and a temperature of 0 to 175° C.

Aspect 11. The method of any one or more of aspects 1 to 10, further comprising removing the catalyst from the product mixture.

Aspect 12. An octane-boosting fuel additive made by the method of any one or more of aspects 1 to 11.

Aspect 13. An unleaded gasoline composition comprising 70 to 99.8 volume percent of an unleaded gasoline; and 0.2 to 20 volume percent of the octane-boosting fuel additive of aspect 12; wherein the unleaded gasoline composition has a higher Research Octane Number, determined in accordance with ASTM D 2699, and a higher Motor Octane Number, determined in accordance with ASTM D 2700 than the unleaded gasoline without the octane-boosting fuel additive.

Aspect 14. The unleaded gasoline composition of aspect 13, having a Reid Vapor Pressure lower than the unleaded gasoline without the octane-boosting fuel additive, wherein Reid Vapor Pressure is determined in accordance with ASTM D 323.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combinations" is inclusive of blends, mixtures, alloys, reaction products, and the like. The terms "a" and "an" and "the" do not denote a limitation of quantity, and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments.

Unless specified to the contrary herein, all test standards are the most recent standard in effect as of the filing date of this application, or, if priority is claimed, the filing date of the earliest priority application in which the test standard appears.

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

Compounds are described using standard nomenclature. For example, any position not substituted by any indicated group is understood to have its valency filled by a bond as indicated, or a hydrogen atom.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A method of manufacturing an octane-boosting fuel additive, the method comprising producing butanol or 2-ethylhexanol;

obtaining n-butyraldehyde, iso-butyraldehyde, or a combination comprising at least one of the foregoing as a crude undistilled by-product of producing butanol or 2-ethylhexanol; and reacting the crude undistilled by-product with glycerol in the presence of an acidic catalyst to obtain an octane-boosting product mixture comprising 2-propyl-5-hydroxy-1,3-dioxane, 2-isopropyl-5-hydroxy-1,3-dioxane, 2-propyl-5-hydroxymethyl-1,3-dioxolane, 2-isopropyl-5-hydroxymethyl-1,3-dioxolane, or a combination comprising at least one of the foregoing.

2. A method of manufacturing an octane-boosting fuel additive, the method comprising producing butanol or 2-ethylhexanol;

obtaining 2-ethylhexenaldehyde, 2-ethylhexaldehyde, or a combination comprising at least one of the foregoing as a crude by-product of producing butanol or 2-ethylhexanol; and reacting the crude by-product with glycerol in the presence of an acidic catalyst to obtain an octane-boosting product mixture comprising 2-(hept-3-en-3-yl)-5-hydroxy-1,3-dioxane, 2-(heptan-3-yl)-5-hydroxy-1,3-dioxane, 2-(hept-3-en-3-yl)-5-hydroxymethyl-1,3-dioxolane, 2-(heptan-3-yl)-5-hydroxymethyl-1,3-dioxolane, or a combination comprising at least one of the foregoing.

3. The method of claim 2, wherein the acidic catalyst comprises p-toluene sulphonic acid, zinc stearate, tetraisopropyl titanate, or a combination comprising at least one of the foregoing.

4. The method of claim 2, wherein the acidic catalyst is present in an amount of 0.05 to 5 weight percent, based on the total weight of the aldehyde and the glycerol.

5. The method of claim 2, wherein the reacting is performed at 0.5 to 5 bar and a temperature of 0° C. to 175° C.

6. The method of claim 2, further comprising removing the acidic catalyst from the product mixture.

7. An octane-boosting fuel additive made by the method of claim 2.

8. A method of preparing an unleaded gasoline composition, the method comprising manufacturing an octane-boosting fuel additive according to the method of claim 1; and combining 70 to 99.8 volume percent of an unleaded gasoline; and 0.2 to 20 volume percent of the octane-boosting fuel additive;

wherein the unleaded gasoline composition has a higher Research Octane Number, determined in accordance with ASTM D 2699, and a higher Motor Octane Number, determined in accordance with ASTM D 2700, than the unleaded gasoline without the octane-boosting fuel additive.

9. The method of claim 8, wherein the unleaded gasoline composition has a Reid Vapor Pressure lower than the unleaded gasoline without the octane-boosting fuel additive, wherein Reid Vapor Pressure is determined in accordance with ASTM D 323.

10. The method of claim 1, wherein the acidic catalyst comprises p-toluene sulphonic acid, zinc stearate, tetraisopropyl titanate, or a combination comprising at least one of the foregoing;

wherein the acidic catalyst is present in an amount of 0.05 to 5 weight percent, based on the total weight of the aldehyde and the glycerol;

wherein the reacting is performed at 0.5 to 5 bar and a temperature of 0° C. to 175° C.; and further comprising removing the acidic catalyst from the product mixture.

11. An octane-boosting fuel additive made by the method of claim 1.

12. A method of preparing an unleaded gasoline composition, the method comprising manufacturing an octane-boosting fuel additive according to the method of claim 2; and combining 70 to 99.8 volume percent of an unleaded gasoline; and 0.2 to 20 volume percent of the octane-boosting fuel additive;

wherein the unleaded gasoline composition has a higher Research Octane Number, determined in accordance with ASTM D 2699, and a higher Motor Octane Number, determined in accordance with ASTM D 2700, than the unleaded gasoline without the octane-boosting fuel additive.

13. The method of claim 12, wherein the unleaded gasoline composition has a Reid Vapor Pressure lower than the unleaded gasoline without the octane-boosting fuel additive, wherein Reid Vapor Pressure is determined in accordance with ASTM D 323.

14. The method of claim 2, wherein the acidic catalyst comprises p-toluene sulphonic acid, zinc stearate, tetraisopropyl titanate, or a combination comprising at least one of the foregoing;

wherein the acidic catalyst is present in an amount of 0.05 to 5 weight percent, based on the total weight of the aldehyde and the glycerol;

wherein the reacting is performed at 0.5 to 5 bar and a temperature of 0° C. to 175° C.; and further comprising removing the acidic catalyst from the product mixture.

15. The method of claim 1, comprising producing butanol.

16. The method of claim 1, comprising producing 2-ethylhexanol.

17. The method of claim 1, wherein producing butanol or 2-ethylhexanol comprises an oxo-alcohol synthetic process.

18. The method of claim 2, comprising producing 2-ethylhexanol.

19. The method of claim 2, comprising producing butanol.

20. The method of claim 19, wherein producing butanol comprises dehydrating an aldol keto-enol reaction product of butyraldehyde produced in an oxo-alcohol synthetic process.

* * * * *